US005080413A

United States Patent [19]

Vobeda

[11] Patent Number: 5,080,413

[45] Date of Patent: Jan. 14, 1992

[54] GOLF BALL RETRIEVER

[76] Inventor: Edwin Vobeda, 4020 Blue River Ave., Racine, Wis. 53405

[21] Appl. No.: 611,723

[22] Filed: Nov. 13, 1990

Related U.S. Application Data

[63] Continuation-in-part of Ser. No. 492,063, Mar. 12, 1990, abandoned.

[51] Int. Cl.[5] ..... A63B 47/02

[52] U.S. Cl. ..... 294/19.2; 294/24

[58] Field of Search ..... 294/19.2, 24, 51, 52, 294/53.5; 56/400.04, 400.06, 400.11, 400.12, 400.19, 400.2; 172/372-375, 378; 273/32 R, 32 B, 32 F, 162 R, 162 B, 162 E, 162 F

[56] References Cited

U.S. PATENT DOCUMENTS

| | | | |
|---|---|---|---|
| 1,123,682 | 1/1915 | Carroll | 56/400.2 |
| 2,343,033 | 2/1944 | Swanson | 56/400.2 |
| 2,523,942 | 9/1950 | Ciambriello | 294/19.2 |
| 2,721,755 | 10/1955 | Walner | 294/19.2 |
| 2,738,214 | 3/1956 | Zimmers | 294/19.2 |
| 3,306,650 | 2/1967 | Zagwyn | 294/19.2 X |
| 3,614,149 | 10/1971 | Clark | 294/19.2 |
| 4,216,831 | 8/1980 | Ritchie | 294/19.2 X |
| 4,411,463 | 10/1983 | Alderman | 294/19.2 |
| 4,659,125 | 4/1987 | Chuan | 294/19.2 |
| 4,799,725 | 1/1989 | Anderson | 294/19.2 |

FOREIGN PATENT DOCUMENTS

| | | | |
|---|---|---|---|
| 88732 | 9/1983 | European Pat. Off. | 294/19.2 |

*Primary Examiner*—Johnny D. Cherry
*Attorney, Agent, or Firm*—Joseph T. Kivlin, Jr.

[57] ABSTRACT

A golf ball retriever having in combination a rake and an open-ended frusto conical tube having at least one outer opening larger than the diameter of a golf ball, and a smaller inner diameter which is large enough to allow a golf ball to be carried in the tube; with the rake having four tines connected perpendicularly to a pivoting axis and extending beyond the larger outer opening in an arcuate configuration around and parallel to the axis of the tube. The tines are pivotable into an operative or inoperative position around the pivoting axis which is perpendicular to the axes of both the tube and the handle, and are spaced less than a golf ball diameter both from the axis of the tube and from each other.

4 Claims, 2 Drawing Sheets

GOLF BALL RETRIEVER

This patent application is a continuation-in-part of my application, Ser. No. 07/492,063 which was filed on Mar. 12, 1990, and which has now been abandoned.

BACKGROUND OF THE INVENTION

This invention relates to an attachment for and an improvement in conventional golf ball retrievers for recovering golf balls which are inaccessible because of their location in deep water or other hazard.

It is well-known that golf balls are frequently driven into inaccessible places, such as water hazards on a golf course. In order to retrieve his ball, the golfer currently employs a device readily available, which consists of a tube on the end of a telescoping handle. As presently designed, the tube consists of a band having diverging openings on each side. That is, the inside surface of the tube comprises a pair of axially aligned frusto cones, with the larger diameter of each being at the outside of the opening. Such outside diameter is somewhat larger than the diameter of a golf ball, with the center of the tube, where the frusto cones meet, having a smaller diameter. When the ball is visible in a water or other hazard, it can be easily retrieved by simply placing the tube over the ball and removing it. In water, the tube appears to function as if it were a suction cup in that the buoyancy of the ball causes it to lodge easily in either of the frusto cones, and it does not easily become dislodged.

The problem with the prior art device is that it is most useful only when the golf ball is visible to the player. If the water is murky, or very deep so that the ball cannot be seen, it cannot be easily located or recovered. One such prior art device is disclosed in the Chuan patent, U.S. Pat. No. 4,659,125 of Apr. 21, 1987.

SUMMARY OF THE INVENTION

The present invention consists of a device which can be readily attached to or manufactured as an integral part of the prior art golf ball retriever described above, which enables the player to engage the ball more easily in one of the frusto conical openings in the band of the retriever. The device of the present invention also makes it possible for the player to remove a ball, which is located in another type of hazard, where reaching in with the tube is not feasible or wherein such reaching is readily assisted.

Thus, the present invention contemplates a device for improving the present band or tube type of retriever by attaching such device to such a retriever. Another aspect of the invention contemplates the integral molding of the improvement into the structure of such retriever.

BRIEF DESCRIPTION OF THE DRAWINGS

Turning to the drawings.

DETAILED DESCRIPTION OF THE INVENTION

Figure 1:
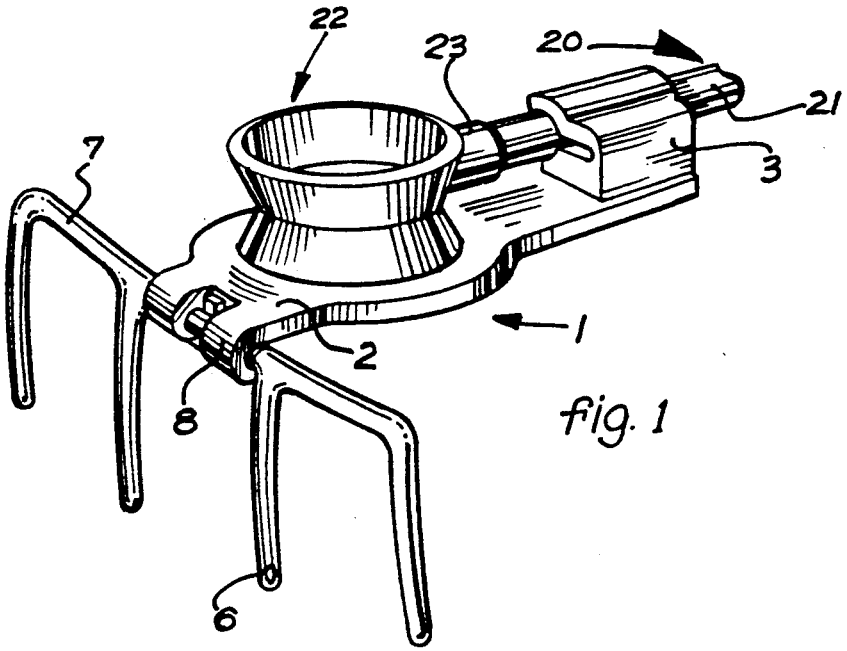
FIG. 1 is a perspective view showing the device of the present invention attached to a conventional golf ball retriever, with the tines in an operable position.

The device of the present invention could be described as a foldable rake, shown generally at 1 in FIG. 1. It consists of plate 2 and clamp 3 for attaching the same to the known golf ball retriever, shown generally at 20. The retriever consists of a handle, partly shown at 21, and a tube or band 22, mounted at its periphery on the end of said handle by means of a coller 23. It will be seen in FIG. 4 that the band consists of two frusto-conical portions 24 and 25. Each is dimensioned to have a diameter at its outer face, which is slightly larger than that of a golf ball.

Figure 3:
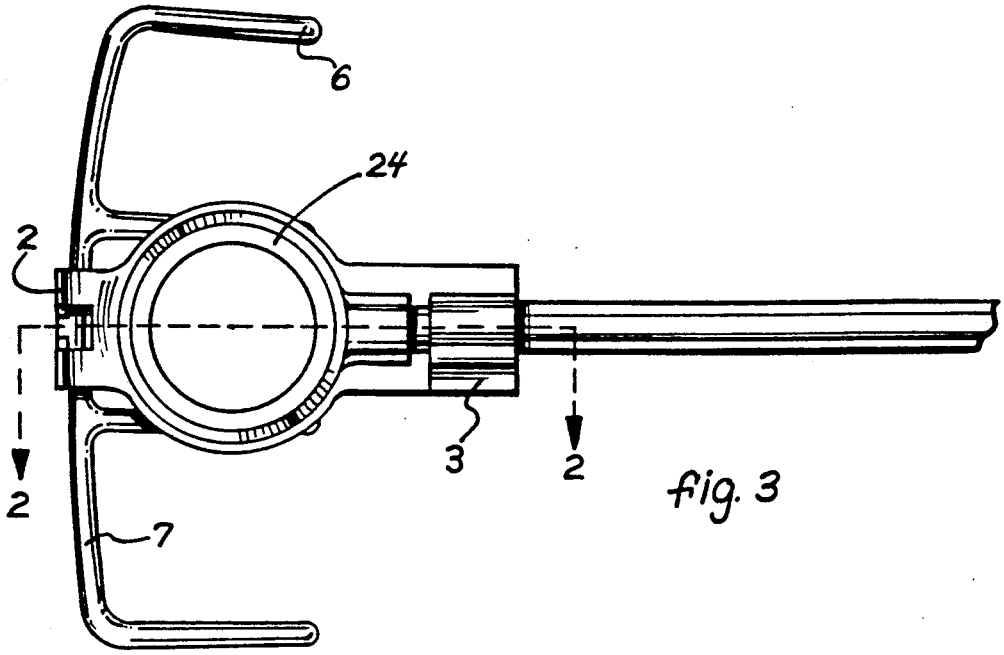
FIG. 3 is a top elevation showing the device of the present invention assembled on a prior art retriever, and showing the tines or fingers in a retracted position.
Figure 2:
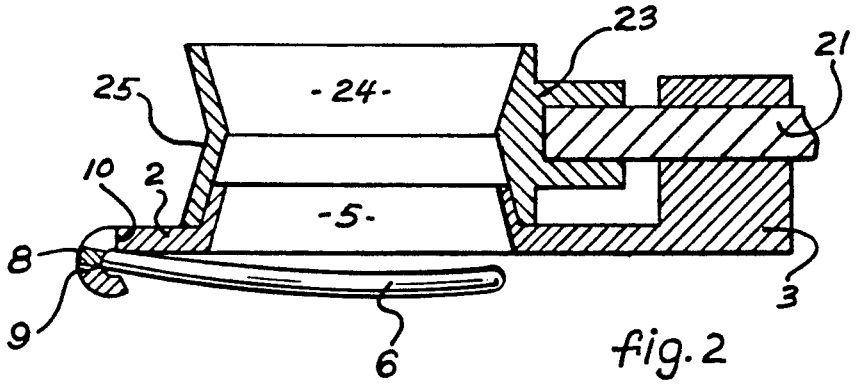
FIG. 2 is a cross section, taken along the line 2—2 in FIG. 3 which shows the tines in a retracted position.

Plate 2 and clamp 3 of the present invention are preferably molded from a suitably flexible synthetic resin, and clamp 3 has suitable dimensions to permit it to be snapped around handle 21 of the retriever and retained thereon by friction. Plate 2 contains a circular flange 5 for engaging the inside of one of the frusto-conical portions 24 or 25 of band 22, as best seen in FIG. 2. Flange 5 has a frusto-conical configuration and a smaller outside diameter than the inside diameter of either half of band 22, so that it may be inserted into either opening of band 22 with its entire outer face engaging the inner face of one of the frusto-cones 24 or 25.

The plate also supports the head of the rake, consisting of number of curved tines 6, mounted on shaft 7. Shaft 7 is attached to the plate 2 at its return portion 8, and is pivotable therein. Shaft 7 may have an arcuate configuration, with its arc extending toward plate 2 when the tines are in an operable position, and it is provided with a stop 9, located diametrically opposite the tines. The stop is disposed within slot 10 of return portion 8 of plate 2, said slot extending from near the extremity of return portion 8 to the top surface of said plate. With such an arrangement, further rotation of shaft 7 is prevented when stop 9 reaches either of the closed ends of slot 10. If said slot is proper location and length, this occurs when the tines are disposed respectively in their operable or closed positions as shown in the drawings.

Figure 4:
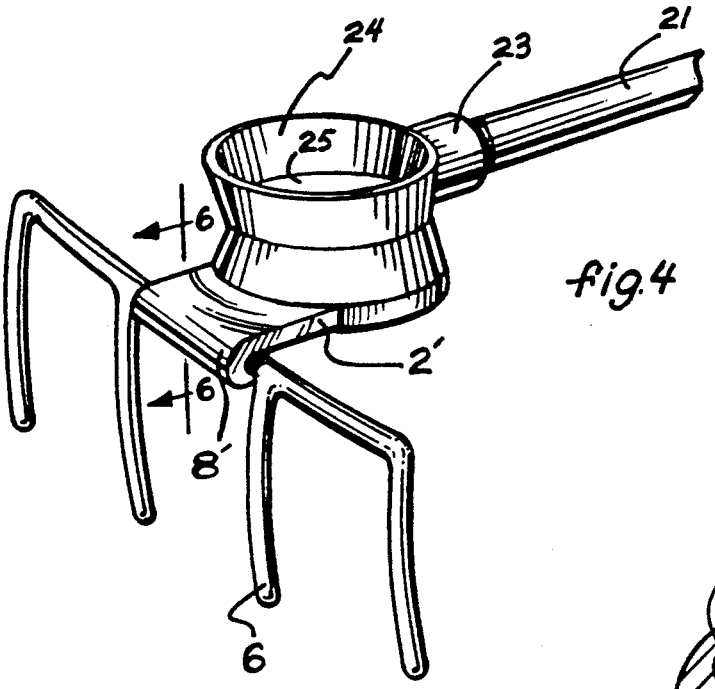
FIG. 4 is a perspective view showing the present invention molded as an integral part of a prior art retriever.
Figure 6:
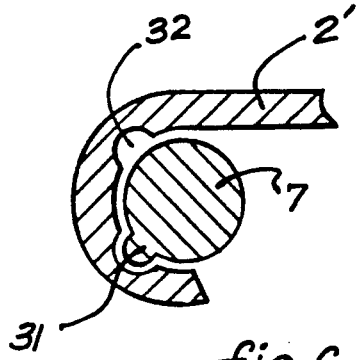
FIG. 6 is a cross section, taken along the line 6—6 in FIG. 4, showing an alternate detent.
Figure 5:
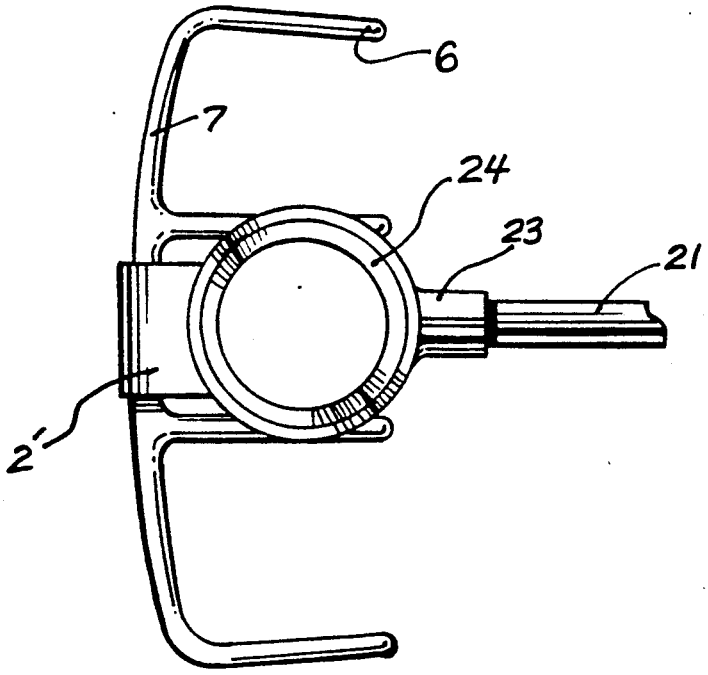
FIG. 5 is a top elevation of the device shown in FIG. 4.

It will be obvious to one skilled in the art of plastic molding that the sizing of shaft 7 and the diameter of return portion 8 will affect the ease of rotation of shaft 7. Similarly, it is obvious, without departing from the scope of this invention, as illustrated in FIG. 6, that the stop or detent 31 could be an axially-extending rib which is retained in the grooves 32, when shaft 7 is rotated. A pair of grooves 32 extend correspondingly on the inside surface of return portion 8, and are spaced from one another an appropriate distance to retain the tines in an operative or closed position as shown in FIGS. 4 and 5, respectively. Such an arrangement would hold the tines in an operative position and in a closed position, according to the user's manipulation of the device.

In operation, when one wishes to retrieve a golf ball from a water or other hazard, especially when it is not visible, one would open the tines of the rake to their operable position and extend the combination rake-retriever of the present invention into the hazard, and draw the ball towards oneself. In water, the ball's buoyancy will cause it to be engaged by the frusto-conical band of the device, whereupon it can be easily removed from the hazard. In other types of hazards, the ball can be drawn toward the user sufficiently to enable the tines to be partly closed and thereby force the ball into one of the frusto conical openings. Closing of the tines can easily be accomplished by pushing the handle away from oneself to force the tines against an object until they begin to pivot around shaft 7. The curvature of the tines then draws up the ball and forces it into the frusto conical opening.

As shown in the drawings, the rake is preferably provided with an even manner of at least four curved tines 6 which may be tapered toward their tips, or have a constant diameter as shown, which are spaced from one another at a distance which is less than a golf ball diameter, and with said curvature extending towards the frusto conical openings. An odd number of tines could be employed without departing from the scope of the present invention, provided that the axis of shaft 21 bisects the space between one pair of tines. With such an arrangement, the ball will be readily buoyed by water into the opening in band 22 when it is aligned by the two central tines of the rake. Similarly, when a ball is lodged in a bramble or underbrush, making it difficult to reach, it can be drawn towards the user by means of the rake of the present invention, and ultimately removed by means of the frusto-conical band when that is more easily employed. Obviously, when the device of the present invention is not in use, the tines of the rake can be folded shut, as shown both in FIGS. 2 and 5 of the drawings, for storage or transportation convenience.

It will also be obvious that the device of the present invention can be molded as an integral part of the golf ball retriever. Thus, as illustrated in FIGS. 4 and 5, the plate 2' can be molded from plastic as an integral part of the band having frusto-conical portions 24 and 25.

After being molded separately, shaft 7 of the rake can be inserted into the return portion 8 of the plate 2 or 2' to complete the assembly. Conventional plastics such as Nylon or high-density polyethylene, or polyvinyl chloride can be used to fabricate the present invention. Desirable properties can be found in a number of the specific materials in those classes to enable the manufacture of a suitable device, according to the present invention. It is important that the plastic be rigid enough that the tines will withstand the use to which it is put without being readily distorted. On the other hand, the plastic must be flexible enough, and the tolerances properly adjusted to enable the distortion of the clamp sufficiently to snap over the shaft to which it is attached, and to enable the rotation of the rake from an operable to an inactive position.

Having thus described my invention, what is claimed is:

1. A golf ball retriever device having in combination:

(a) A handle;

(b) An open-ended tube mounted at its periphery at one end of said handle, said tube having an inner surface consisting of a pair of axially aligned frusto cones, each having an outer diameter larger than the diameter of said ball, and an inner diameter smaller than said ball diameter, but large enough to allow said ball to be carried in said tube; and (c) A rake mounted on the periphery of said tube diametrically opposite said handle, said rake consisting of a shaft with four tines attached thereto which are evenly spaced over the length of said shaft, said shaft being pivotally attached at its center to said handle, and being pivotable around an axis which is perpendicular to the axes of both said tube and said handle to move said tines into an operative or inoperative position, said tines extending perpendicularly from said shaft beyond one of said outer openings, and being spaced less than said ball diameter both from the axis of said tube and from each other.

2. The golf ball retriever device of claim 1, wherein said tines, when in an operative position, extend in the configuration of a cylinder whose axis is parallel to the axis of said tube.

3. The golf ball retriever device of claim 2, wherein said tines extend beyond said outer diameter for a distance greater than the radius of a golf ball.

4. The golf ball retriever device of claim 3, wherein each of said tines is curved towards said tube in an arc having a diameter greater than said ball diameter.

* * * * *